United States Patent [19]

Yanabu et al.

[11] Patent Number: 4,665,289

[45] Date of Patent: May 12, 1987

[54] PUFFER TYPE GAS INSULATED CIRCUIT BREAKER

[75] Inventors: Satoru Yanabu, Machida; Hitoshi Mizoguchi, Yokohama; Hisatoshi Ikeda, Zushi; Katsumi Suzuki; Mitsuru Toyoda, both of Yokohama, all of Japan; Edmond Thuries, Villeur Banne, France

[73] Assignees: Kabushiki Kaisha Toshiba, Kawasaki, Japan; Alsthom, Paris, France

[21] Appl. No.: 857,178

[22] Filed: Apr. 29, 1986

[30] Foreign Application Priority Data

May 8, 1985 [JP] Japan ..... 60-96001

[51] Int. Cl.[4] ..... H01H 33/88

[52] U.S. Cl. ..... 200/148 A; 200/148 R

[58] Field of Search ..... 200/148 A, 148 R

[56] References Cited

U.S. PATENT DOCUMENTS 4,440,997 4/1984 Garzon ..... 200/148 A 4,450,330 5/1984 Zuckler ..... 200/148 A

*Primary Examiner*—Robert S. Macon

*Attorney, Agent, or Firm*—Oblon, Fisher, Spivak, McClelland & Maier

[57] ABSTRACT

A puffer type gas insulated circuit breaker has releasably engaging stationary and movable arc contacts contained in a vessel filled with an arc extinguishing gas. An operation rod serving as a supporting member of the movable arc contacts has openings and helps define a puffer chamber. In the breaker, gas is pressurized by an arc generated between said stationary arc contacts and said movable arc contacts in an initial breaking phase, this gas being taken into the puffer chamber. The holes are used as a heat exhaust passage.

4 Claims, 4 Drawing Figures

PUFFER TYPE GAS INSULATED CIRCUIT BREAKER

BACKGROUND OF THE INVENTION

1. Field of the Invention

The present invention relates to an improvement in the structure of an arc extinguishing chamber and, more particularly, to a puffer type gas insulated circuit breaker using arc energy.

2. Description of the Related Art

With the trend toward an increased capacity of a transmission system, the realization of a circuit breaker with an increased breaking capacity and high reliability has been desired. For the sake of enhancing the reliability of the circuit breaker, it is important to reduce the number of the structural elements used as well as to simplify the entire structure. To this end, it is necessary to decrease the number of the breaking points of the circuit breaker. Consequently, the breaking capacity per breaking point of that breaker must be increased.

For this reason, a conventional puffer type gas insulated circuit breaker has adopted a method for further increasing gas pressure in a puffer chamber so as to enhance the breaking capacity, that is, breaking performance. Specifically, a practical method in which a large puffer cylinder is operated with high speed to allow a large volume of gas to be blown against an arc at high pressure in the puffer chamber for the purpose of arc extinction, can be adopted.

However, with the above-mentioned method, the size of the arc extinction chamber having such a puffer cylinder not only becomes large, but bulky driving means for driving the cylinder are also needed, resulting in a costly circuit breaker with a less flexible operation.

SUMMARY OF THE INVENTION

An object of the invention is, therefore, to provide a puffer type gas insulated cirucit breaker which is small in size and free from the above-mentioned disadvantages of the prior art breaker.

Another object of the invention is to provide a puffer type gas insulated circuit breaker operable with less driving energy and improved breaking performance.

According to an aspect of the present invention, there is provided a puffer type gas insulated circuit breaker which includes releasably engagable stationary and movable arc contacts which are opposedly disposed and contained in a vessel filled with an arc extinguishing gas, an operation rod serving as a supporting member of the movable arc contacts and having openings, and a puffer chamber. The arc extinguishing gas is pressurized by an arc generated between the stationary arc contacts and the movable arc contacts in an initial breaking period. The thus pressurized gas is permitted to flow into the puffer chamber and the openings of the operation rod are used as a heat exhaust passage.

With this structure, the present invention provides a puffer type gas insulated circuit breaker which is small in size, excellent in breaking performance, operable with less driving energy and capable of effectively increasing gas pressure in the puffer chamber.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DETAILED DESCRIPTION OF THE PREFERRED EMBODIMENT

Figure 1:
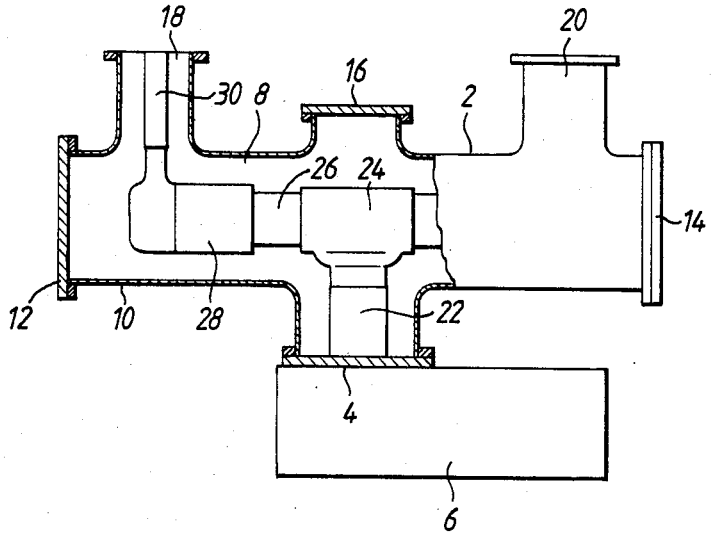
FIG. 1 shows a block diagram of an embodiment of the present invention.

Referring to FIG. 1, an embodiment of the present invention includes a circuit breaker unit 2 and a driving device 6 connected through a lid 4 to the unit 2. This unit is provided with a cylindrical vessel 10 filled with an arc extinguishing gas 8 such as SF6 gas. Lids 12, 14 and 16 are respectively provided on both ends and the upper central portion of the vessel for the sake of easy assembly and maintenance. Devices such as bushings are coupled to projected portions 18 and 20 which extend upwardly close to both ends of the vessel 10. A conductive centerpiece 24 is fixed via an insulating cylinder 22 to the lid 4 at an approximately central portion of the vessel 10.

Conductive connecting members 26 are fixed at both ends of the centerpiece 24 along the axial direction of the vessel 10. It is to be noted that the circuit breaker unit 2 has a symmetrical structure with respect to the centerpiece 24. Therefore, for simplicity, description will be given for only the left-hand half of the structure. An arc extinguishing chamber 28 disposed at the axial center of the vessel 10 is attached to the connecting member 26. A conductor 30 extending through the projected portion 18 is connected to the other end of the extinguishing chamber 28. The puffer type gas insulated circuit breaker is electrically connected, via the conductor 30, to external devices. The aforementioned bushes, not shown, seal the projected portion 18 around the conductor 30. In the closed state of the circuit breaker, a current flows either from the left hand conductor 30 to the right hand conductor along the path defined by the left-hand conductor 30, the left-hand arc extinguishing chamber 28, the left-hand connecting member 26, the centerpiece 24, the right-hand connecting member, the right-hand arc extinguishing chamber, and the right-hand conductor, or along the same path in a reverse direction.

Figure 2:
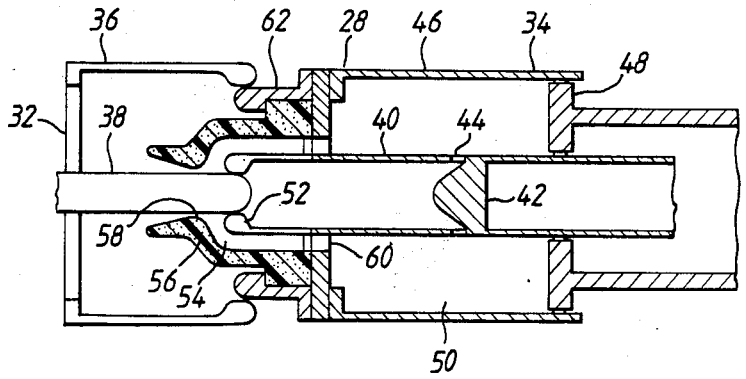
FIG. 2 is a partial cross-sectional view showing the closed state of an arc extinction chamber of the embodiment in FIG. 1.

The arc extinguishing chamber 28 has a construction as shown in FIG. 2, which shows the closed state of the present circuit breaker. The chamber 2B is made up of a stationary contact portion 32 and a movable contact portion 34 which are releasably engagable with each other.

The stationary contact portion 32 has a cylindrical array of stationary contacts 36 serving as a main electrical current passing portion and a stationary arc contact 38 provided almost coaxially within the array of contacts 36 and electrically connected thereto.

On the other hand, the movable contact portion 34 is provided with a conductive and hollow cylindrical operation rod 40 connected (by means not shown) to the driving device 6 shown in FIG. 1 for transmitting a driving force. A sealing member 42 is formed midway in the operation rod 40 for axially partitioning the hollow portion into two sections. A central part of the sealing portion 42 projects toward the stationary contact portion 32. Also, the rod 40 has a plurality of openings 44 on the side thereof facing the stationary contact portion 32 and in the vicinity of the sealing member 42 so that gases at the inner and outer portions of the rod 40 can communicate with one another. It is assumed that the effective passage area of the openings 44 is S'.

A conductive puffer cylinder 46 is coaxially positioned around the circumference of the end of the rod 40 and fixed thereto by means, not shown, to form a space between the cylinder 46 and the rod 40. A fixed puffer piston 48 is provided in said space between the cylinder 46 and the rod 40 and is supported so that it is slidable with respect to the movable members 46 and 40. A puffer chamber 50 is formed in a space defined by the operation rod 40, puffer cylinder 46 and puffer piston 48. The openings 44 formed in the rod 40 are positioned so that they communicate with the puffer chamber 50 in the closed state of the circuit breaker (FIG. 2), whereas the openings 44 are positioned on the side of the piston 48 opposite the contact portion 32 in the fully breaking state (FIG. 4), so that the openings 44 do not communicate with the puffer chamber 50 in the fully breaking state.

An array of hollow cylindrical movable arc contacts 52 having almost the same diameter as the rod 40 is secured to the end of the operation rod 40 on the side thereof facing the contact portion 32. The contacts 52 of this array are releasably engaged with the circumference of the stationary arc contact 38. More specifically, the movable arc contacts 52 make contact with the stationary arc contact 38 in the closed state of the circuit breaker. On the other hand, the contacts 52 and 38 are released from each other in the breaking state of the circuit breaker. It should be noted that the minimum passage area S of the array of contacts 52, obtained by cutting them in a direction perpendicular to the axis thereof, satisfies the relationship: $S<S'$, where S' is the effective passage area of the openings 44.

Figure 3:
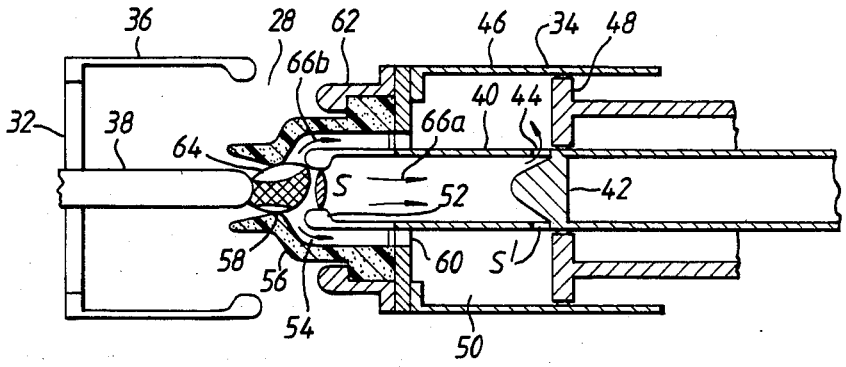
FIG. 3 is a partial cross-sectional view showing the initial breaking state of the arc extinguishing chamber of FIG. 2.

A tubular insulating nozzle 56 is formed around the movable arc contacts 52 and is attached to the end plate of the puffer cylinder 46 on the side of the contact portion 32 to define a gas passage 54. Gas passage 54 has a throat portion 58. In the closed state of the circuit breaker, the stationary arc contact 38 is held within the throat portion 58 and is spaced from the arc contact 38 by a slight space. In contrast, in the breaking state (FIG. 4), the arc contact 38 is entirely out of the throat portion 58. When the tip of the stationary arc contact 38 is at the throat portion (FIG. 3), the openings 44 formed in the rod 40 communicate with the puffer chamber 50 but are adjacent the piston 48. The gas passage 54 then communicates with the puffer chamber 50 through openings 60 provided in the end plate of the puffer cylinder 46 on the side thereof facing the contact portion 32.

A hollow cylindrical array of movable contacts 62 for passing an electrical current are secured to the end plate of the puffer cylinder 46 and surround the insulating nozzle 56. The contacts 62 form a main electrical current passing portion and are releasably engaged with the inner circumference of the stationary contacts 36 for passing an electrical current when in the closed state of FIG. 2. The relative positioning of the contacts 36, 62, 38, and 52 is defined so that the release of the movable arc contacts 52 from the stationary arc contact 38 is performed after the movable contacts 62 are released from the stationary contacts 36. The contacts 52 and 62 are always connected electrically, for example, via the end plate of the puffer cylinder 46. Furthermore, the contacts 36, 38, 52 and 62, the rod 40, the puffer cylinder 46, the puffer piston 48 and the insulating nozzle 56 are mutually disposed on or about a common axis.

The operation of the above embodiment will be described in detail hereunder referring to FIGS. 1 to 4.

In the closed state of the circuit breaker, the movable contact portion 34 is held engaged with the stationary contact portion 32 after the contact portion 34 has moved fully to the left as seen in FIG. 2. In other words, the movable arc contacts 52 contact the stationary contact 38, and the movable contacts 62 for passing an electrical current contact the stationary contacts 36 for passing an electrical current. Also, the stationary contact 38 is held within the insulating nozzle 56 so as to substantially close one end of the gas passage 54. On the other hand, the other end of the gas passage 54 communicates with the puffer chamber 50 via the openings 60 to allow the volume of the chamber 50 to have the maximum value. Most of the current flows between the contacts 36 and 62.

Assuming now that the driving force from the driving device 6 shown in FIG. 1 is transmitted to the operation rod 40 by means not shown, the movable contact portion 34 moves toward the right, except for the fixed piston 48. With the movement of the contact portion 34, the movable contacts 62 are released from the stationary contacts 36 first. As a result, all the current formerly flowing between these contacts 36 and 62 is caused to instead flow between the stationary arc contact 38 and the movable arc contacts 52. Namely, all the current flowing in the puffer type gas insulated circuit breaker will then flow between the contacts 38 and 52.

With further rightward movement of the contact portion 34, the breaking operation advances to release the movable arc contacts 52 from the stationary arc contact 38. At this time, an arc 64 is generated between the contacts 38 and 52 (see FIG. 3). An arc extinguishing gas 8 present around the circumference of the arc 64 is heated to provide an expansion flow of high temperature and high pressure because of the high heat of the arc 64. Since the throat portion 58 of the insulating nozzle 56 is almost closed by the contact 38 in the initial breaking state, the expansion flow is divided into an expansion flow **66*a* proceeding through the inside of the movable arc contacts 52 and an expansion flow 66*b* proceeding through into the gas passage 54**.

Meanwhile, during the rightward movement of the contact portion 34, the puffer cylinder 46 also moves in the same direction. As a result, the volume of the puffer chamber 50 is decreased with resulting increased gas pressure. However, the expansion flow has not yet reached the chamber 50.

Consequently, the expansion flow **66*a* abruptly flows into the chamber 50 via the inside of the movable arc contacts 52, the inside of the operation rod 40 and the openings 44. This can be smoothly performed because of the sealing member 42, whose central portion projects toward the side of the stationary contact 32, is formed in the rod 40 and because the minimum passage area S of the contacts 52 and the effective passage area S' of the openings 44 in the rod 40** have a relationship of $S<S'$.

In addition, the expansion flow 66*b* abruptly flows into the puffer chamber 50 through the gas passage 54 and the openings 60 formed in the cylinder 46. Both the flow of these expansion flows 66*a* and 66*b* into the chamber 50 and the decrease of the puffer chamber volume effectively contribute to an increase of the gas pressure in the chamber 50.

Figure 4:
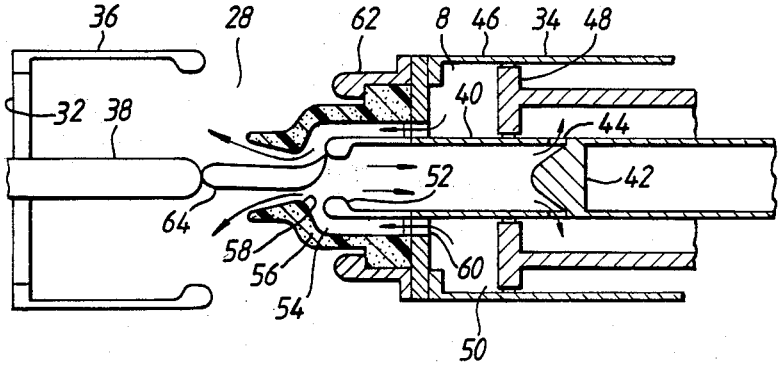
FIG. 4 is a partial cross-sectional view showing the later breaking state of the chamber of FIG. 2.

In response to further rightward movement of the movable contact portion 34, as shown in FIG. 4, the throat portion 58 of the nozzle 56 is fully opened. The openings 44 of the rod 40 are then positioned behind the puffer piston 48 so as not to communicate with the puffer chamber 50. The gas pressure in the chamber 50 is then further increased due to a further decrease of the volume of the chamber 50 caused by the rightward movement of the puffer cylinder 46. The high pressure arc extinguishing gas 8 in chamber 50 is thus blown onto the arc 64 through the gas passage 54 as shown by arrows in FIG. 4. The arc extinguishing gas 8 is divided into a gas flow proceeding toward the side of the stationary arc contact 38 through the throat portion 58 of the nozzle 56 and a heated gas flow advancing through the inside of the operation rod 40. The former gas flow exits the nozzle 56 through a space between the contact 38 and the insulating nozzle 56. On the other hand, the latter flow of hot gases exits through the inside of the operation rod 40 and the openings 44 for heat removal. Consequently, the arc 64 is securely extinguished at a current zero point.

Since the arc extinguishing gas operating on the arc 64 has a high temperature, the arc extinguishing chamber 28 can have a long life with high reliability by the adoption of a heat-resistant structure for the inner and outer circumferences of the operation rod 40, the inner circumference of the puffer cylinder 46, etc., which are exposed to the arc extinguishing gas having high temperature.

One skilled in the art will appreciate that various changes or substitutions can be made to the embodiment mentioned above without departing from the spirit and scope of the invention defined by the appended claims.

What is claimed as new and desired to be secured by letters patent of the United States is:

1. A puffer type gas insulated circuit breaker comprising:

a vessel filled with an arc extinguishing gas;

releasably engagable stationary and movable contact means defining an arc extinguishing chamber;

means for driving said movable contact means between a closed state and a breaking state;

a hollow cylindrical operation rod forming a part of said movable contact means and having openings therein, one end of said operation rod being coupled to said driving means for transmitting said driving force to said movable contact means;

a sealing member provided inside said operation rod;

movable arc contact means forming a portion of said movable contact means, said movable arc contact means having a hollow cylindrical shape and being secured to an end of said operation rod on a side thereof facing said stationary contact means;

a puffer cylinder fixed to the outside of said operation rod and forming a part of said movable contact means, said puffer cylinder cooperating with said operation rod to define a space therebetween;

a puffer piston disposed in said space between said puffer cylinder and said operation rod and movable with respect to both said puffer cylinder and said operation rod;

a puffer chamber defined in said space by said operation rod, said puffer cylinder and said puffer piston, said openings in said operation rod being positioned so as to communicate an interior of said operation rod with said puffer chamber only in said closed state and an initial portion of said breaking state of said circuit breaker;

an insulating nozzle fixed to said puffer cylinder and having a throat portion, said insulating nozzle cooperating with said movable arc contact means to form a gas passage; and stationary arc contact means comprising a portion of said stationary contact means and releasably engagable with said movable arc contact means in said closed state of said circuit breaker, wherein said stationary arc contact means are inserted into said throat portion in said closed state and in said initial breaking state.

2. A puffer type gas insulated circuit breaker as claimed in claim 1 wherein said operation rod openings are positioned such that said puffer chamber is released from communication with said openings as soon as said stationary arc contact means are moved out of said throat portion during operation of said driving means.

3. A puffer type gas insulated circuit breaker as claimed in claim 1 wherein an effective passage area of said operation rod openings is larger than a minimum passage area of said movable arc contact means.

4. A puffer type gas insulated circuit breaker as claimed in claim 1 including stationary and movable electrical current passing contacts respectively forming portions of said stationary and movable contact means, said electrical current passing contacts being releasably engaged when said circuit breaker is in said closed state and being positioned to mutually separate before separation of said arc contacts when said circuit breaker is in said breaking state.

* * * * *